United States Patent [19]

Scheidler et al.

[11] 3,978,633

[45] Sept. 7, 1976

[54] BUILDING ELEMENT

[75] Inventors: Herwig Scheidler, Mainz; Klaus Kristen, Wiesbaden, both of Germany

[73] Assignee: Jenaer Glaswerk Schott & Gen., Mainz, Germany

[22] Filed: Jan. 14, 1975

[21] Appl. No.: 540,967

[30] Foreign Application Priority Data

Jan. 18, 1974 Germany ..... 7401645[U]
Feb. 27, 1974 Japan ..... 7406776[U]

[52] U.S. Cl. ..... 52/400; 52/475; 52/509; 52/511; 52/573; 52/614; 52/759

[51] Int. Cl.[2] ..... E04B 1/62

[58] Field of Search ..... 52/506, 509, 510, 511, 52/475, 616, 308, 385, 390, 391, 573, 624, 614, 397, 235, 656, 759, 400

[56] References Cited

UNITED STATES PATENTS

| | | | |
|---|---|---|---|
| 3,035,446 | 5/1962 | Ross | 52/495 X |
| 3,460,303 | 8/1969 | Algrain et al. | 52/616 X |
| 3,672,107 | 6/1972 | Santry | 52/235 |
| 3,802,143 | 4/1974 | Adler et al. | 52/400 |

*Primary Examiner*—Ernest R. Purser
*Assistant Examiner*—Carl D. Friedman
*Attorney, Agent, or Firm*—Littlepage, Quaintance, Murphy & Dobyns

[57] ABSTRACT

A construction element consisting of a sheet of material having plane front and back surfaces is joined to a base by an attachment means secured to the back surface of the sheet adjacent to the edge of the sheet. The attachment means comprises a frame having an aperture means opening away from the back surface of the sheet for receiving threaded elements and securing the sheet to the base and includes a homogeneous, permanently resilient substance positioned between the frame and the sheet having sufficient flexibility to allow for the difference in thermal expansion between the frame and the sheet and having sufficient tensile strength to hold the sheet to the frame.

7 Claims, 5 Drawing Figures

BUILDING ELEMENT

BACKGROUND OF THE INVENTION

1. Field of the Invention

The present invention relates to means for attaching plate building elements to a base and particularly concerns such an attachment means for attaching plate building elements of glass ceramic having a small coefficient of thermal expansion.

2. Description of the Prior Art

When decorative sheet or plate building elements composed of glass, glass-ceramic or similar material having a coefficient of thermal expansion less than $50 \times 10^{-7}/°C$ are attached to a metallic base, typically steel, the building element is subjected to repeated stresses and strains as the ambient temperature changes. Normal attachment means such as bolts placed through holes in the sheet building element and secured to the base cause undesirable mechanical stress by the relatively greater thermal expansion of the base leading to frequent fracturing of the plate building element.

Another attachment means which has been used includes a rim of metal cushioned with rubber or asbestos extending over onto the front surface of the plate. The rim protects the edge of the plate but represents an esthetically unpleasing appearance and a source of dirt that is difficult to remove. Furthermore, the use of such rims makes it impossible to provide a flat surface comprising of a plurality of the construction plates.

It is, therefore, an object of the present invention to provide a means for attaching plate elements which have a coefficient of thermal expansion of less than $50 \times 10^{-7}°C$ which can safely and easily attach the plate element to a base having a coefficient of thermal expansion greater than that of the plate element while minimizing the mechanical stresses transferred to the plate element by the difference in coefficients of thermal expansion.

A further object of the invention is to provide a means for attaching plate elements of the type which have no rim extending above the front surface of the plate element thereby permitting the simultaneous arrangement of a plurality of the plates into a large plane surface having no discontinuities.

SUMMARY OF THE INVENTION

According to this invention, an improved attachment means for attaching a sheet or plate of material having generally plane parallel front and back surfaces comprises a frame secured to the back surface of the sheet adjacent to the edge of the sheet, the frame having aperture means opening away from the back surface of the sheet for receiving threaded elements for securing the frame to an appropriate base and a homogeneous, permanently resilient substance positioned between the frame and the sheet having sufficient flexibility to allow for the difference in thermal expansion between the frame and the sheet and having sufficient adhesive strength to hold the sheet to the frame.

The frame can be made of metal, plastic or other structural material and can embrace the edge of the sheet but can not extend beyond a plane coplanar with the front surface of the sheet. The frame comprises generally a channel member having a web parallel to the back surface of the sheet. The web is in intimate contact with the resilient substance positioned between the frame and the sheet. The frame includes two flanges depending perpendicularly from the web substantially parallel to each other, each flange having a rim closing toward the opposite flange thereby defining an aperture. The rim can consist of a continuously inwardly-sloping surface thereby forming a dovetail opening and can enclose a plurality of female threaded elements such as nuts. The resilient substance is preferably a suitable binding means such as a silicone rubber having a tensile strength of at least 285 $lbs./in^2$.

The base to which the building element is to be attached can include a plurality of male elements appropriately threaded into the apertures defined by the flange rims. The male element terminates behind the back surface of the sheet building element and does not extend through the sheet element. Preferably, the base comprises a means for biasing the sheet member in a frontward direction and includes a number of stop members positioned on the threaded male elements, a number of spring means positioned on the frontward side of the stop members, a plate or cross-bar extending between the male elements in a plane substantially parallel to the sheet member of a frontward side of the spring means and a pressure bearing member extending from the plate or cross-bar to the back surface of the sheet building element thereby biasing the sheet in a frontward direction. The biasing means can also comprise means for holding heating or illuminating elements and the like against the sheet member.

DESCRIPTION OF THE PREFERRED EMBODIMENTS

Figure 1:
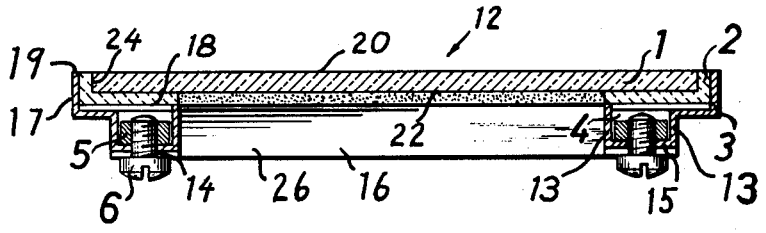
FIG. 1 shows a cross-sectional side view of one embodiment of a construction element with attachment means of the present invention.

FIG. 1 shows a sectional view of one embodiment of a construction element according to the present invention. The construction element comprises a sheet of material 1 having a generally plane front surface 20, a back surface 22 generally parallel to the front surface 20, and an edge 24 defining the perimeter of and joining the front and back surfaces. The front surface 20 can be decoratively embossed yet still be generally plane. The invention has particular utility when the sheet 1 is constructed of a glass, glass-ceramic, or other material having a coefficient of thermal expansion of less than $50 \times 10^{-7}/°C$.

The construction element further comprises an attachment means 26 comprising a frame 3 secured to the back surface 22 and edge 24 of the sheet 1 by a homogeneous permanently resilient substance 2 which is preferably an elastic silicone rubber glue. The tensile strength of the resilient substance must be at least 285 lbs/in² and lies preferably between 285–430 lbs/in². An example of one adhesive satisfying these requirements is FD-Plast which is manufactured by the firm of Compakta-Werke of Trauenreut, Bavaria. This particular silicone glue has a tensile strength of 320 lbs/in².

Figure 2:
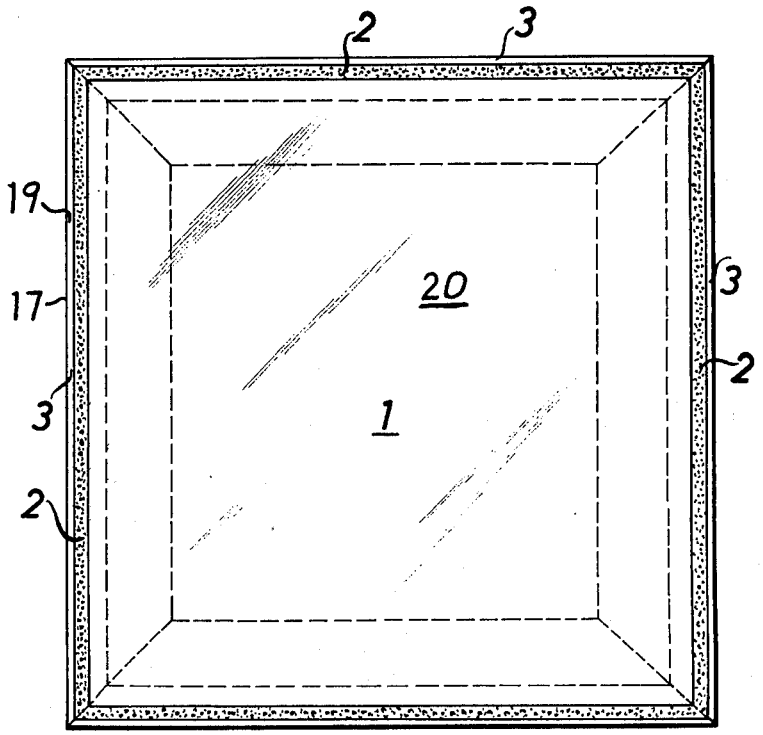
FIG. 2 is a top view of the construction element with attachment means of FIG. 1.

The frame 3 includes an aperture means 14 opening away from the back surface 22 of the sheet 1 for receiving a threaded element 6. The frame comprises a channel member 16 having a web 18 parallel to the back surface 22 and in intimate contact with the resilient substance 2. Depending perpendicularly from the web 18 substantially parallel to each other are two flanges 13. Each flange 13 has a rim 15 closing toward the opposite flange thereby defining the aperture 14. Enclosed within the flanges 13 are a plurality of female threaded elements 5 adapted to receive corresponding male threaded elements 6 for securing the construction element 12 to a base (not shown). The frame 3 further comprises a lip 17 extending over the edge of and embracing the sheet 1 as shown in FIG. 2. The lip 17 terminates in a terminating edge 19 at or behind a plane coplanar with the front surface 20 of sheet 1.

Figure 3:
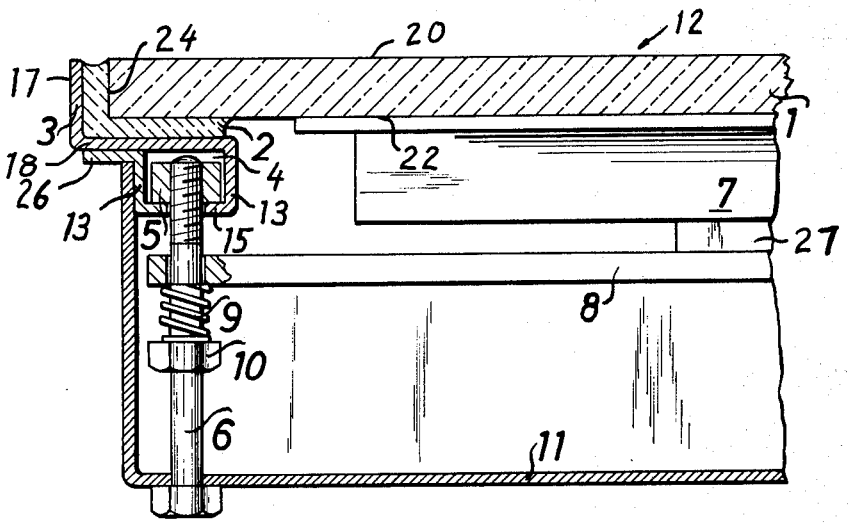
FIG. 3 is a sectional view of a construction element with a second embodiment of the attachment means in combination with a base.

The combination of the construction element with attachment means according to this invention with a base 11 is shown in FIG. 3. A sheet of material 1 having plane parallel back and front surfaces 20 and 22 respectively are secured to base 11 by an attachment means 26 including a frame 3 secured to the sheet by a permanently resilient adhesive substance 2. The frame 3 comprises a web 18 in contact with the adhesive substance 2, two flanges 13 depending perpendicularly from the web 18 to parallel to each other. The frame includes a frontward extending lip 17 surrounding the perimeter 24 of the sheet 1. The flanges 13 enclose a plurality of female threaded elements 5 receiving corresponding male threaded elements 6 securing the construction element 12 to the base 11. The male elements 6 terminate in a space 4 behind the back surface 22 of sheet 1 and between the flange rims 15 and web 18.

Adjustably positioned on a number of the male elements 6 are a corresponding number of stop members 10 and a number of spring means 9 positioned on the frontward side of the stop members 10 between the stop members 10 and the sheet 1. A cross-bar or plate 8 extends between the number of male members 6 and a plane substantially parallel to sheet 1 and on a frontward side of the spring means 9. The cross-bar 8 is biased in a frontward direction by the spring means 9. A pressure bearing member 27 holds a light or heat radiant element 7 against the back surface 22 of sheet 1 thereby biasing the sheet in a frontward direction. Stop means 10 is preferably adjusted such that the tension created on the adhesive substance 2 between web 18 and sheet 1 is less than 285 lbs/in².

Figure 4:
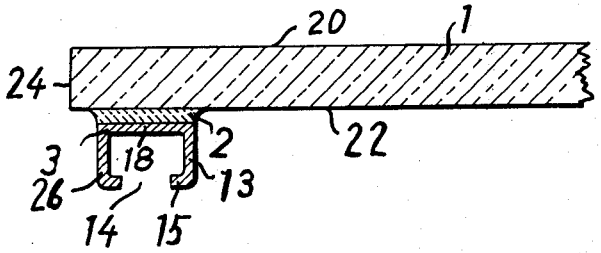
FIG. 4 is a sectional view of a construction element having an attachment means according to this invention, the attachment means excluding any lip extending over the edge of and embracing the sheet.
Figure 5:
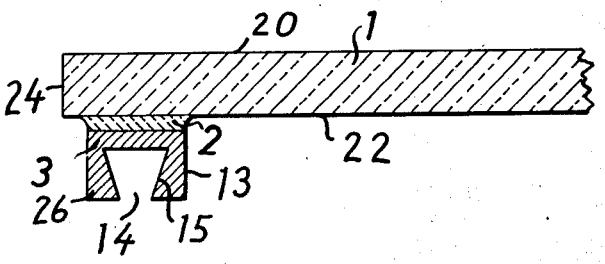
FIG. 5 is a view similar to that of FIG. 4 of yet another embodiment of the present invention where the attachment means consists of flanges having rims which are continuously inwardly-sloping surfaces forming a dovetail recess.

FIGS. 4 and 5 illustrate yet two other embodiments of attachment means 26 which together with the embodiment shown in FIG. 1 may be substituted for that shown in FIG. 3. In FIG. 4, the frame 3 comprises a web 18, two spaced-apart flanges 13 arranged substantially perpendicularly to the back surface 22 of sheet 1 and parallel to each other. Each flange 13 has a rim 15 closing toward the opposite flange thereby defining an aperture 14 for receiving a threaded element (not shown). In FIG. 5, the rim 15 comprises a continuously inwardly-sloping surface forming an aperture 14 in the form of a dovetail.

The lip 17 of FIG. 3 need not extend completely around the edge 24 of sheet 1 but rather can be present only near the corners of sheet 1 thus functioning as a corner protector. The permanently flexible adhesive 2 between the sheet 1 and the mounting means 3 should be of such a thickness as to elastically absorb the change in relative dimensions experiences between the frame 3 and sheet 1 under varying temperature conditions so as to prevent the sheet 1 from experiencing any harmful mechanical strain. The thickness of the adhesive 2 depends on the size, thickness and the overall shape geometry of the frame 3 and sheet 1.

Although the invention has been described in considerable detail with references to certain preferred embodiments thereof, it will be understood that variations and modifications can be effected within the spirit and scope of the invention as described above and as defined in the appendage claims.

We claim:

1. The combination of a base and a construction element comprising:

a sheet of material having a generally plane front surface, a back surface generally parallel to the front surface, and a planar edge defining the perimeter of and joining the front and back surfaces, and an attachment means secured to the back surface of the sheet adjacent to the edge of the sheet for attaching the sheet to the base, the attachment means comprising a frame having two spaced apart flanges arranged substantially perpendicularly to the back surface of the sheet and parallel to each other, each flange having a rim closing toward the opposite flange defining an aperture for receiving a threaded element for securing the construction element to the base, a homogeneous, permanently resilient adhesive substance positioned between the frame and the sheet having sufficient flexibility to allow for the difference in thermal expansion between the frame and the sheet and having sufficient adhesive strength to hold the sheet to the frame, and means situated between the sheet and the base for biasing the sheet with respect to the base in a frontward direction away from the base.

2. The combination of claim 1 wherein said sheet is a material having a coefficient of thermal expansion of less than $5 \times 10^{-6}/°C$.

3. The combination of claim 1 wherein said adhesive substance comprises a silicone rubber glue having a tensile strength of between 285 lbs/in² and 430 lbs/in².

4. The combination of claim 1 wherein said flanges enclose a plurality of female threaded elements and wherein said base comprises a corresponding plurality of male elements appropriately threaded into the female element for securing said construction element to the base, each male element having one terminal end positioned between said flange rims and said back surface of said sheet.

5. The combination of claim 4 wherein said means for biasing said sheet in a frontward direction comprises a number of stop members positioned on a corresponding number of said plurality of male elements, a number of spring means positioned on the frontward side of the stop members, a cross-bar extending between the number of male elements in a plane substantially parallel to said sheet and on the frontward side of said spring means, and a pressure bearing member extending frontward from the cross-bar to said back surface thereby biasing said sheet in a frontward direction.

6. The combination of:

a sheet of material having a front surface, a back surface parallel to the front surface, and a planar edge defining the perimeter of and joining the front and back surfaces, a base, and an attachment means secured to the back surface of the sheet adjacent to the edge of the sheet for attaching the sheet to the base, the attachment means comprising:

a frame having two spaced-apart flanges arranged substantially perpendicularly to the back surface of the sheet and parallel to each other, each flange having a rim closing toward the opposite flange and enclosing a plurality of female threaded elements for securing the sheet to the base, and a homogeneous, permanently resilient adhesive substance positioned between the frame and the sheet having sufficient flexibility to allow for the difference in thermal expansion between the frame and the sheet and having sufficient adhesive strength to hold the sheet to the frame, said base comprising a plurality of male elements appropriately threaded into corresponding members of said plurality of female threaded elements, the male elements having one terminal end positioned between said flange rims and said back surface of said sheet, and means situated between the sheet and the base for biasing the sheet with respect to the base in a frontward direction away from the base.

7. The combination of:

a sheet of material having a plane front surface, a back surface parallel to the front surface, and a planar edge defining the perimeter of and joining the front and back surfaces, a base, and an attachment means secured to the back surface of the sheet immediately adjacent to the edge of the sheet for attaching the sheet to the base, the attachment means comprising:

a frame having two spaced-apart flanges arranged substantially perpendicularly to the back surface of the sheet and parallel to each other, each flange having a rim closing toward the opposite flange and enclosing a plurality of female threaded elements for securing the sheet to the base, and a homogeneous, permanently resilient, adhesive substance positioned between the frame and the sheet having sufficient flexibility to allow for the difference in thermal expansion between the frame and the sheet and having sufficient adhesive strength to hold the sheet to the frame, said base comprising a plurality of male elements appropriately threaded into corresponding members of said plurality of female threaded elements, the male elements having one terminal end positioned between said flange rims and said back surface of said sheet and a means for biasing said sheet in a frontward direction comprising:

a number of stop members positioned on a corresponding number of said plurality of male elements, a number of spring means positioned on the frontward side of the stop members, a cross-bar extending between the number of male elements in a plane substantially parallel to said sheet and on the frontward side of said spring means, a pressure bearing member extending frontward from the cross-bar, and a means mounted in front of the pressure bearing member and against the back surface of said sheet for holding radiant elements against the back surface of the sheet thereby biasing the sheet in a frontward direction.

* * * * *